US007503794B2

(12) United States Patent
Haller

(10) Patent No.: US 7,503,794 B2
(45) Date of Patent: Mar. 17, 2009

(54) ELECTRICAL PLUG CONNECTOR FOR SOLAR PANEL

(75) Inventor: Wolfgang Haller, Schwalkheim (DE)

(73) Assignee: Hirschmann Automation and Control GmbH, Neckartenzlingen (DE)

( * ) Notice: Subject to any disclaimer, the term of this patent is extended or adjusted under 35 U.S.C. 154(b) by 0 days.

(21) Appl. No.: 11/901,276

(22) Filed: Sep. 14, 2007

(65) Prior Publication Data

US 2008/0070448 A1 Mar. 20, 2008

(30) Foreign Application Priority Data

Sep. 16, 2006 (DE) ..... 10 2006 043 574

(51) Int. Cl.
*H01R 13/627* (2006.01)

(52) U.S. Cl. ..... 439/357; 439/332

(58) Field of Classification Search ..... 439/357, 439/332, 335, 889, 489
See application file for complete search history.

(56) References Cited

U.S. PATENT DOCUMENTS 2,704,356 A * 3/1955 Herterick ..... 439/332
2,729,800 A * 1/1956 Knudsen ..... 439/335
4,255,007 A * 3/1981 Michaels et al. ..... 439/332
5,120,234 A * 6/1992 Mergless ..... 439/357
5,885,280 A * 3/1999 Nettekoven et al. ..... 606/41
6,027,359 A * 2/2000 Aoki et al. ..... 439/357
6,132,233 A * 10/2000 Fukuda ..... 439/357
6,206,714 B1 * 3/2001 Bernardini ..... 439/335
6,297,741 B1 * 10/2001 Higgins ..... 340/631
6,332,800 B2 * 12/2001 Kodama ..... 439/357
6,409,534 B1 * 6/2002 Weisz-Margulescu ..... 439/367
6,808,407 B1 * 10/2004 Cannon ..... 439/314
7,294,014 B2 * 11/2007 Drescher et al. ..... 439/489
7,318,758 B2 1/2008 Haller ..... 439/843
2001/0016444 A1 * 8/2001 Fenger ..... 439/358
2003/0013338 A1 * 1/2003 Birkenmaier et al. ..... 439/332
2003/0194899 A1 * 10/2003 Ueda ..... 439/357
2006/0172587 A1 * 8/2006 Drescher et al. ..... 439/489

* cited by examiner

*Primary Examiner*—Neil Abrams
*Assistant Examiner*—Harshad C Patel
(74) *Attorney, Agent, or Firm*—Andrew Wilford

(57) ABSTRACT

An electrical connector has an elongated generally circular-section socket part centered on an axis and an elongated generally circular-section plug part centered on an axis and coaxially fittable in the socket part in an assembled position of the connector. An axially projecting latch tab formed with a radially inwardly open hole on one of the parts can engage and lock on a radially projecting latch lug on the other of the parts and fittable in the hole in the assembled position of the connector. The lug has an angularly extending angled ramp and an axially extending ramp. The latch tab is axially and angularly engageable with the ramps.

10 Claims, 4 Drawing Sheets

ELECTRICAL PLUG CONNECTOR FOR SOLAR PANEL

FIELD OF THE INVENTION

The present invention relates to an electrical plug connector for joining a pair of cables. More particularly this invention concerns such a connector used to hook up a solar panel.

BACKGROUND OF THE INVENTION

A solar panel is obviously exposed to the elements in all kinds of weather. In addition such panels are subject to periodic replacement or servicing. Thus it is important that the electrical hookups for them be extremely robust, yet capable of relatively simple connection and disconnection. The electrical connection must also seal tightly and be capable of transmitting the typically low-voltage/high-current electricity produced by the panel with no appreciable loses.

In US 2007/0049125 a plug connector is described for connection of two cables each having an outer jacket and an inner conductor projecting from the respective jacket. The a connector assembly has a tubular plug housing extending along a respective longitudinal axis and formed with a radially inwardly projecting bead forming an axially outwardly directed shoulder and, axially outward from the bead, a radially enlarged-region. A contact plug in the plug housing is formed with a pin projecting axially inward from the respective bead and bearing axially outward on the respective bead, a pair of hooks axially outward of the respective bead and bearing axially inward on the shoulder thereof, whereby the hooks lock the contact plug in the plug housing, and a crimp connector axially outward of the respective bead and gripping the conductor of one of the cables. A seal in the radially enlarged region of the plug housing bears radially inward on the jacket of the one cable whose conductor is gripped by the crimp connector of the contact plug. A tubular socket housing extending along a respective longitudinal axis is formed with a radially inwardly projecting bead forming an axially outwardly directed shoulder and, axially outward from the respective bead, a radially enlarged region. A contact socket in the socket housing is formed with a sleeve projecting axially inward from the respective bead and bearing axially outward on the respective bead, a pair of hooks axially outward of the respective bead and bearing axially inward on the shoulder thereof, whereby the hooks lock the contact socket in the socket housing, and a crimp connector axially outward of the respective bead and gripping the conductor of the other of the cables. Another seal in the radially enlarged region of the socket housing bears radially inward on the jacket of the other cable whose conductor is gripped by the crimp connector of the contact socket. The socket housing and the plug housing are fittable axially together with the cables extending axially oppositely away from each other and with the pin of the contact plug fitted snugly inside the sleeve of the socket housing. One of the housings is formed radially inward of the respective bead with a radially inwardly open groove. A seal ring in the groove radially inwardly engages the other of the housings when the housings are fitted together.

Such a connector has worked fairly well, but requires considerable force to disconnect when the connector has been in use outside for some time, as is common for a connector on a solar panel. The disconnection force is typically longitudinal, so that the worker on the roof must grip the connector in both hands and pull it longitudinally apart, something that can be difficult and dangerous in this work setting, especially when the unit is somewhat frozen together.

OBJECTS OF THE INVENTION

It is therefore an object of the present invention to provide an improved electrical plug connector for solar-panel cables.

Another object is the provision of such an improved electrical plug connector for solar-panel cables that overcomes the above-given disadvantages, in particular that can be opened and closed with relative ease, but that otherwise meets all the requirements—e.g. water tightness, low connection ohmage, durability—of such a connector.

SUMMARY OF THE INVENTION

An electrical connector has according to the invention an elongated generally circular-section socket part centered on an axis and an elongated generally circular-section plug part centered on an axis and coaxially fittable in the socket part in an assembled position of the connector. An axially projecting latch tab formed with a radially inwardly open hole on one of the parts can engage and lock on a radially projecting latch lug on the other of the parts and fittable in the hole in the assembled position of the connector. The lug has an angularly extending angled ramp and an axially extending ramp. The latch tab is axially and angularly engageable with the ramps.

The underlying idea for the invention is that a round plug and a round socket with high-current contacts are longitudinally mated and latched. The releasing or unlatching process occurs initially using a relative rotary movement between the plug and socket and a subsequent linear movement. The latching is a simple relative longitudinal or axial movement.

This results in the advantage that plug and socket can be rapidly and simply mated based on the linear movement, and locking when mated is effective and can be disconnected or could only be disconnected with extremely high forces when the tensile forces that normally occur when the plug-type connector is operating act on the plug-type connector. Thus the plug-type connector when latched can be effectively and lastingly maintained together due to forces that normally during operation do not act transverse to the longitudinal direction. However, if the plug-type connector is to be intentionally disassembled, that is the plug and socket are to be pulled apart, initially a relative rotary movement by plug and socket is necessary in order to nearly eliminate the detent effect so that there can then be a longitudinal movement for releasing the plug-type connector. Due to this basic idea of the invention, which can be attained using appropriate shapes of the detent, the forces when coupling and also when pulling apart the plug and socket can be minimized, while at the same time the detent connection when latched is effective such that it is nearly impossible to separate the plug and socket when tensile forces are applied to the plug-type connector.

According to the invention the one part is the plug part and the other part is the socket part. In addition the tab is elastically radially outwardly deflectable by the ramps.

The hole in accordance with the invention is dimensioned to fully receive the lug. Each of the ramps forms an outwardly open large obtuse angle with adjacent outer surfaces of the other part, and each of the ramps is generally planar.

The other part according to the invention has a jacket and a core, the latter being softer than the jacket. In addition the jacket is formed around the lug with a cutout that is generally complementary to and that receives the tab in the assembled position. This jacket blocks interfitting of the two parts except when the tab is aligned axially with the cutout. The core is formed with the lug.

The lug of the inventive system has an edge directed away from the one part, extending generally in a plane perpendicular to the axis of the other part, and engageable with an inside edge of the hole in the tab.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
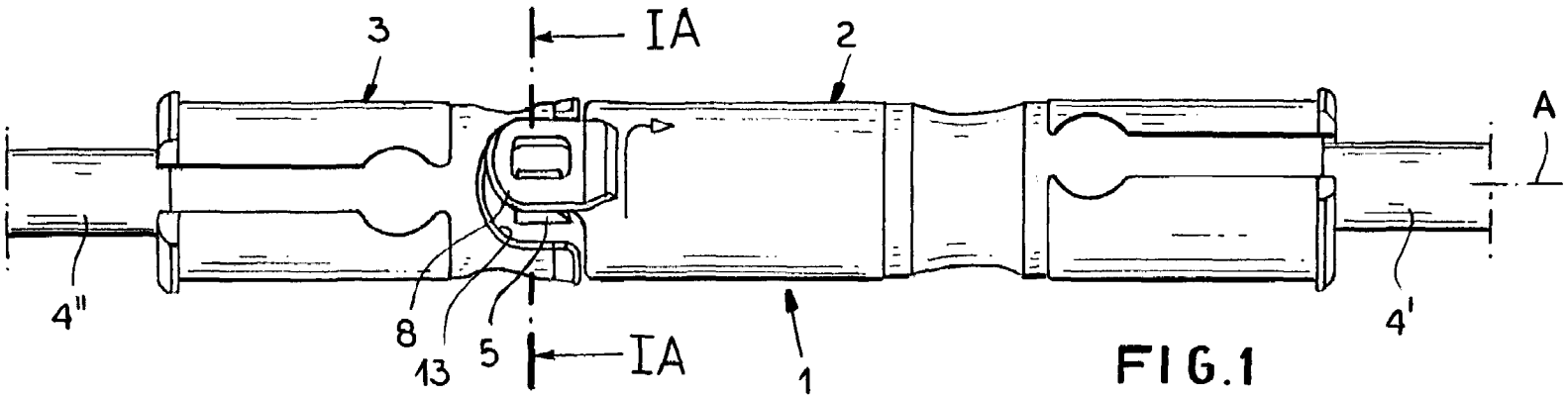
FIG. 1 is a side view of the connector according to the invention in the unlatched position.
Figure 1D:
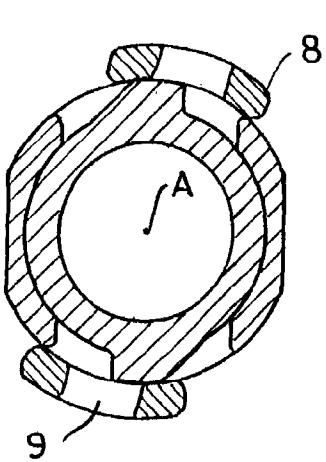
FIGS. 1A-1D are sections taken along line IA of FIG. 1 showing the coupling in successive positions between a latched position (FIG. 1A) and a fully unlatched position (FIG. 1D)
Figure 1C:
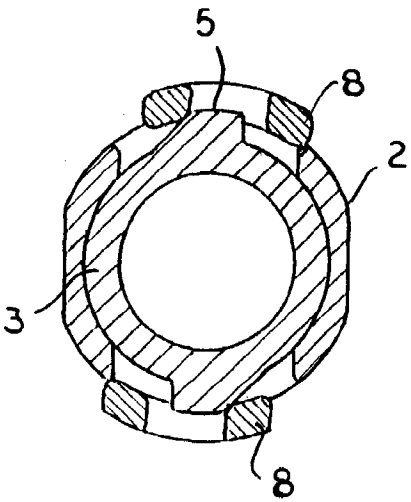
Figure 1B:
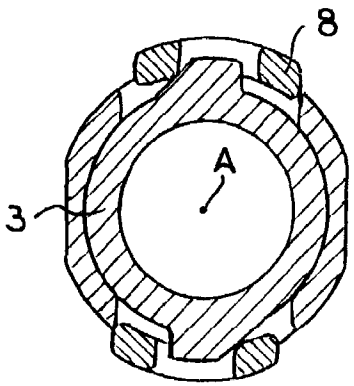
Figure 1A:
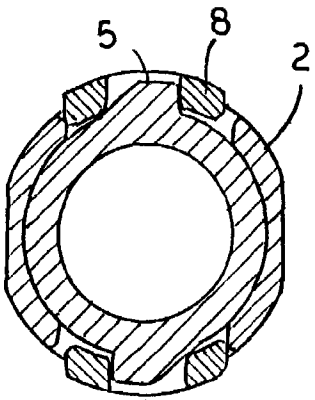

As seen in FIGS. 1-4, a plug-type connector 1 extending along a longitudinal axis A has a round socket 2 and a round plug 3 that are mounted on the ends of respective cables 4' and 4*n* each having as is standard an insulating sheath surrounding a conductive core wire. In a known manner, the core wire of each cable 4 is connected to a respective high-current contact in the socket 2 and in the plug 3. At least one detent lug 5 is provided on the round plug 3, two diametrally opposite such detent lugs 5 preferably being attached to the surface of the housing of the round plug 3. This detent lug has an axially extending first ramp 6 and a radially extending second ramp 7 that is transverse thereto (FIG. 3) and that can be mechanically linked to a latch tab 8 on the round socket 2. The tab 8 is formed with a detent hole 9 into which the lug 5 can fit, and when there are two lugs 5, there are two tabs 8.

The first ramp 6, which rises in the longitudinal direction when the parts 2 and 3 are latched, can cam out the end of the latch tab 8 so it can slide over this ramp 6. After the round socket 2 and the round plug 3 have been completely latched, the hole 9 of the latch tab 8 receives the detent lug 5 completely. Because of the shown shape of the detent lug 5, when longitudinal forces act oppositely on the plug 2 and socket 3 of the plug-type connector 1 in the latched condition the latter is prevented from coming apart because the outer edge of the hole 9 abuts a generally perpendicular end face 12 of the detent lug 5 (opposite the first ramp 6).

Figure 2A:
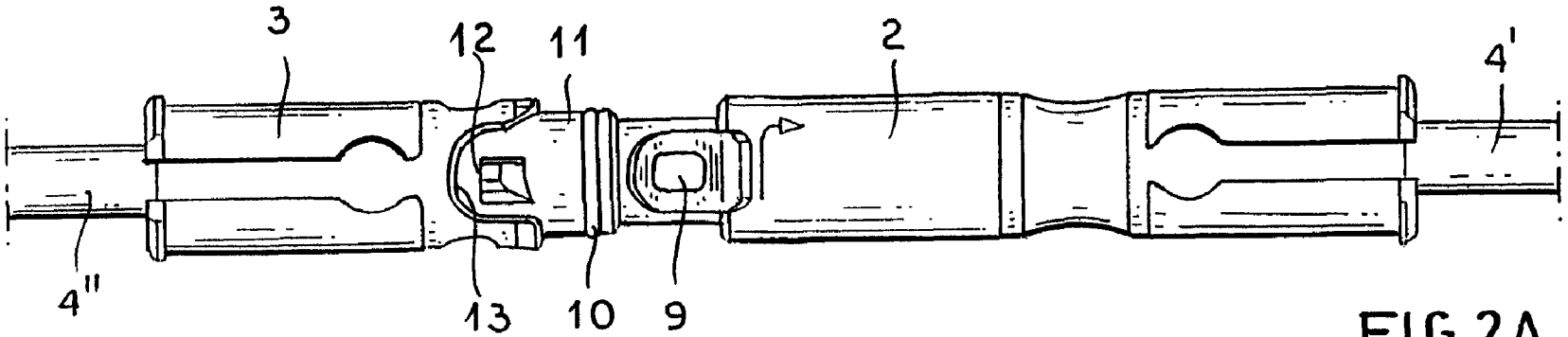
FIGS. 2A-2C are side views showing the connector in successive positions as the two parts are moved from a disengaged position (FIG. 2A) to an engaged and latched position (FIG. 2C)
Figure 2B:
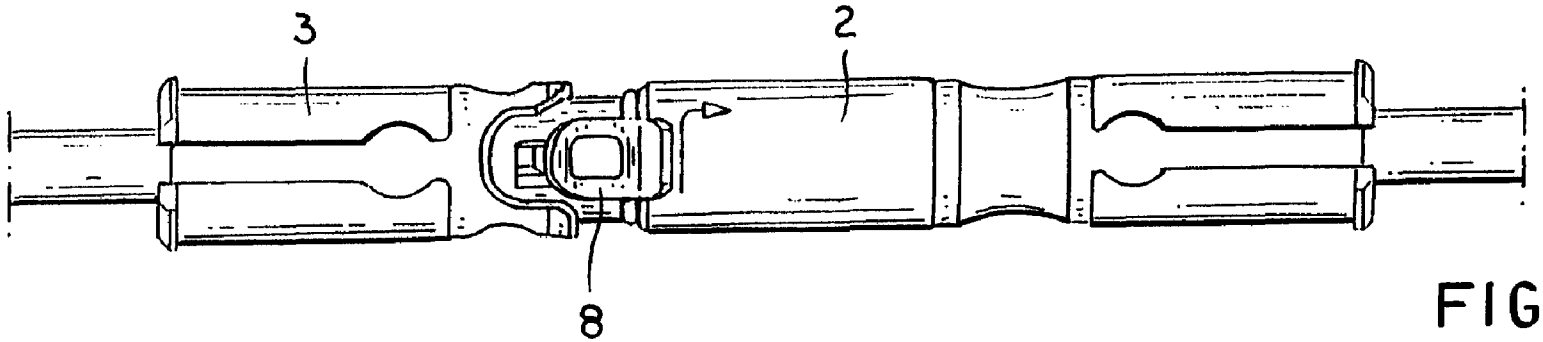
Figure 2C:
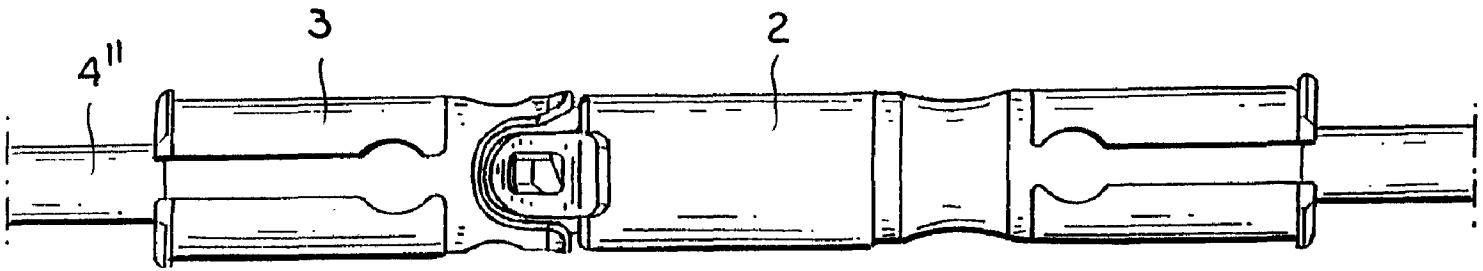

Thus it is possible as shown in FIGS. 2A through 2C to assembly the connector 1 according to the invention simply by aligning the tab 8 with the lug 5 and pushing the two parts 2 and 3 longitudinally together. Misalignment during assembly is impossible because the socket 3 has a jacket 13 formed around the lug 5 with a notch or cutout 14 generally complementary to the tab 8 so that, if the tab 8 is not aligned with the cutout 14, the part 2 cannot be fitted all the way to the part 3, as the tab 8 will hit the end edge of the jacket 3. Once the two parts 2 and 3 are fitted together as shown in FIG. 2C, even a very strong tension exerted tending to pull the part 2 out of the part 3 will not be able to separate them. As mentioned, the tab 8 is cammed during assembly outward so that it deforms elastically. Once it reached a position where the lug 5 can fit into the hole 9, the tab 8 snaps inward, making an audible click that clearly indicates to the installer that the connector 1 is fully engaged.

The task of disassembling or disconnecting the plug-type connector 1 with the least possible expenditure of force is attained using the second ramp 7, which is oriented transverse to the longitudinal direction of the plug-in connector 1. Using an intentional rotation between round socket 2 and round plug 3, which rotation does not normally occur during operation of the plug-type connector 1, the latch tab 8 can slide as shown in FIGS. 1A through 1D over this second ramp 7 so that the entire latch tab 8 is cammed out by the detent lug 5 and the latch effect is eliminated. The entire angular displacement from the fully latched or engaged position of FIG. 1A to the fully unlatched position of FIG. 1D (see also FIG. 3B) is only 15°.

Figures 4A, 4B, 4C:
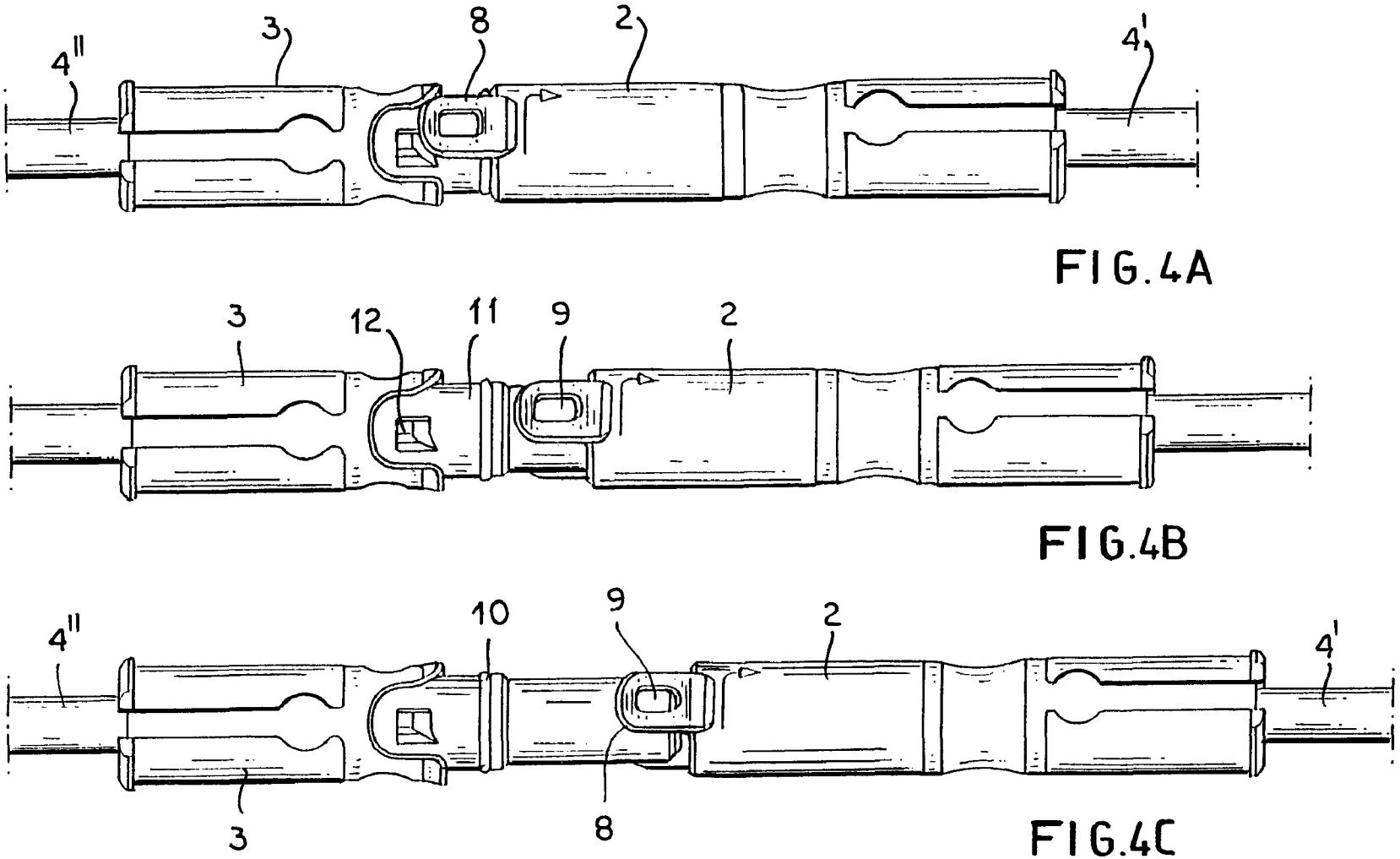
FIGS. 4A-4C are side views of showing the connector in successive positions as the two parts are moved from the unlatched but engaged position (FIG. 4A) to the unlatched and disengaged position (FIG. 4C).

Once the tab 8 has been freed from the lug 5 as shown in FIG. 4A through 4C, a simple axial separation of the two parts 2 and 3 is sufficient to completely undo the connector 1

Figure 3B:
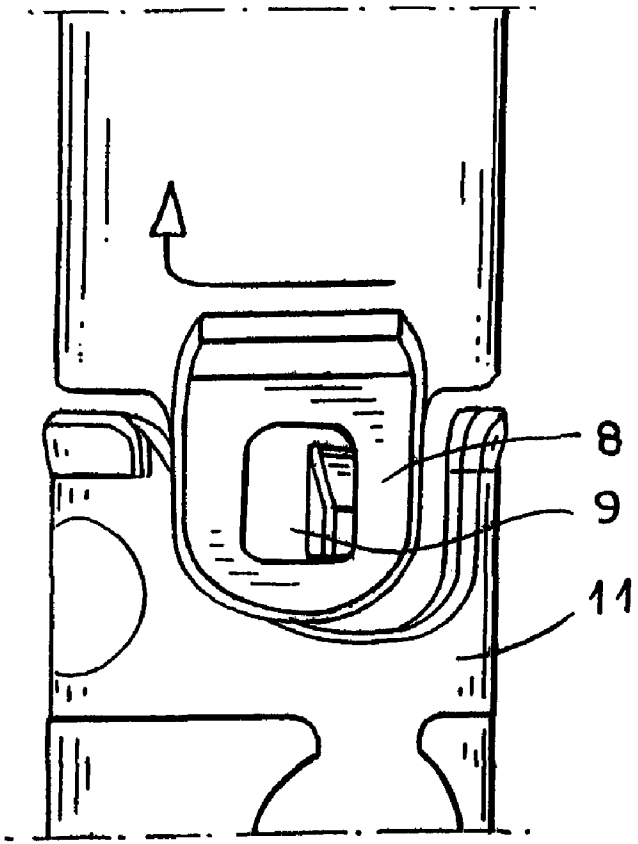
FIGS. 3A and 3*b* are large-scale side views correspondingly generally to the positions of FIGS. 2A and 1D.
Figure 3A:
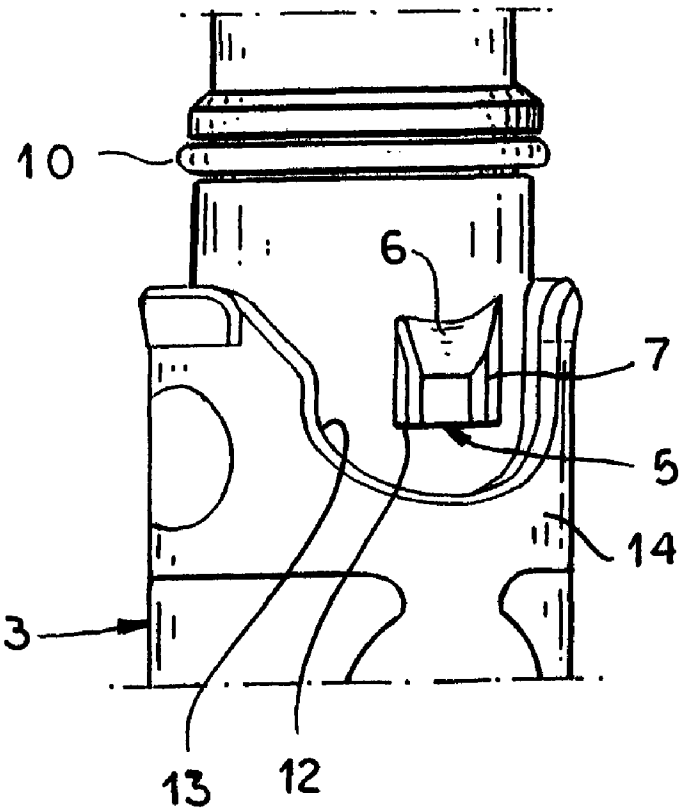

The illustration in FIG. 3 (bottom left) illustrates that the side of the detent lug 5 that opposes the ramp 7 oriented transverse to the longitudinal direction of the round plug 3 runs approximately perpendicular to the surface of the housing for the detent plug 3. While two opposing second ramps 7 are conceivable, this embodiment has the advantage that round socket 2 and round plug 3 need be rotated in only one direction in order to release the lock. Moreover, it can be seen in this illustration that the detent lug 5 is embodied like a plateau in order to be able to keep the structural height of the detent lug 5 low while retaining the locking effect. The height of the plateau of the detent lug 5 is somewhat selected such that it closes with the surface of the latch tab 8.

For further minimizing the mating forces, it is conceivable that the latch tab 8 comprises an elastically deformable material or has a longitudinal extension such that only small forces are necessary when moving the latch tab 8 over the detent lug 5. With regard to the shape and the material selection for the latch tab 8, it is important that its hole 9 completely receives the detent lug 5 when the plug-type connector 1 is fully assembled.

For attaining a required longitudinal water-tight seal, the round plug 3 has an O-ring seal 10. In addition, the round plug 3 can have an insert or inner core body 11 that comprises a material that is softer than the normally metallic jacket 13 for the round plug 3 so that the insert 11 is used as a buffer during mating.

It was previously shown in the FIGS. and described in the description that the round plug has the detent lug 5 and the round socket 2 has the latch tab 8. Naturally, it is also alternatively possible for the round socket 2 to have the detent lug 5 and the round plug 3 to have the latch tab 8 without departing from the inventive thought.

I claim:

1. An electrical connector comprising:

an elongated generally circular-section socket part centered on an axis;

an elongated generally circular-section plug part centered on an axis and coaxially fittable in the socket part in an assembled position of the connector;

an axially projecting latch tab formed with a radially inwardly open hole on one of the parts; and a radially projecting latch lug on the other of the parts and fittable in the hole in the assembled position of the connector, the lug having an angularly extending angled ramp and an axially extending ramp, the latch tab being axially and angularly engageable with the ramps, each of the ramps forming an outwardly open large obtuse angle with adjacent outer surfaces of the other part, the lug being formed with an axially extending side face facing angularly oppositely to the angularly extending ramp and generally perpendicular to adjacent outer surfaces of the other part, whereby from the assembled position relative rotation of the parts in one direction cams out the tab but opposite relative rotation of the parts is blocked by the side face.

2. The electrical connector defined in claim 1 wherein the one part is the plug part and the other part is the socket part.

3. The electrical connector defined in claim 1 wherein the tab is elastically radially outwardly deflectable by the ramps.

4. The electrical connector defined in claim 1 wherein the hole is dimensioned to fully receive the lug.

5. The electrical connector defined in claim 1 wherein each of the ramps is generally planar.

6. The electrical connector defined in claim 1 wherein the lug has an edge directed away from the one part, extending generally in a plane perpendicular to the axis of the other part, and engageable with an inside edge of the hole in the tab.

7. An electrical connector comprising:

an elongated generally circular-section socket part centered on an axis;

an elongated generally circular-section plug part centered on an axis and coaxially fittable in the socket part in an assembled position of the connector;

an axially projecting latch tab formed with a radially inwardly open hole on one of the part, the other part having a jacket and a core; and a radially projecting latch lug on the other of the parts and fittable in the hole in the assembled position of the connector, the lug having an angularly extending angled ramp and an axially extending ramp, the latch tab being axially and angularly engageable with the ramps, the jacket being formed around the lug with a cutout that is generally complementary to and that receives the tab in the assembled position.

8. The electrical connector defined in claim 7 wherein the jacket blocks interfitting of the two parts except when the tab is aligned axially with the cutout.

9. The electrical connector defined in claim 7 wherein the core is softer than the jacket.

10. The electrical connector defined in claim 7 wherein the other part is the plug and the core is formed with the lug.

* * * * *